US008347569B1

(12) United States Patent
McIntyre et al.

(10) Patent No.: US 8,347,569 B1
(45) Date of Patent: Jan. 8, 2013

(54) SELF-ADJUSTING COPLANAR ACM PANEL MOUNTING SYSTEM SECURED BY NOVEL RETAINING CLIP

(76) Inventors: J. Andrew McIntyre, Hudson, OH (US); Peter J. Desantis, Alpharetta, GA (US)

( * ) Notice: Subject to any disclaimer, the term of this patent is extended or adjusted under 35 U.S.C. 154(b) by 51 days.

(21) Appl. No.: 12/834,871

(22) Filed: Jul. 12, 2010

Related U.S. Application Data

(63) Continuation-in-part of application No. 11/371,292, filed on Mar. 9, 2006, now Pat. No. 7,752,818.

(51) Int. Cl.
*E04H 1/00* (2006.01)

(52) U.S. Cl. ..... 52/235; 52/474; 52/766

(58) Field of Classification Search ..... 52/235, 52/762, 766, 767, 772, 775, 780, 781
See application file for complete search history.

(56) References Cited

U.S. PATENT DOCUMENTS 4,452,029 A * 6/1984 Sukolics ..... 52/747.1
4,833,858 A * 5/1989 Hutchison ..... 52/475.1
5,263,292 A * 11/1993 Holland et al. ..... 52/235
5,809,729 A * 9/1998 Mitchell ..... 52/474

* cited by examiner

*Primary Examiner* — Jeanette E Chapman
*Assistant Examiner* — Daniel Kenny
(74) *Attorney, Agent, or Firm* — Joseph H. Taddeo

(57) ABSTRACT

A self-leveling structural element in a non-progressive attachment system, a U-shaped retentive clip having a base and two upwardly extending arms that are forced apart by the installation of a self-drilling screw, the novel retentive clip with screw coacting with an extruded frame to mount and retain a plurality of aluminum composite material (ACM) panels in a coplanar manner, to form an Aluminum Composite Cladding System, for a non-progressive system that enables removal of individual panels for replacement or repair.

12 Claims, 15 Drawing Sheets

SELF-ADJUSTING COPLANAR ACM PANEL MOUNTING SYSTEM SECURED BY NOVEL RETAINING CLIP

CLAIM FOR BENEFIT OF PREVIOUSLY FILED APPLICATIONS

Applicants claim the benefit of Standard Utility patent application Ser. No. 11/371,292, filed Mar. 9, 2006, now U.S. Pat. No. 7,752,818, issued Jul. 13, 2010.

FIELD OF INVENTION

The present invention relates primarily to a mounting system for building facings formed of aluminum composite material (ACM) panels secured by a deformable clip in a non-progressive system that enables removal of individual panels for replacement or repair.

BACKGROUND OF THE INVENTION

The use of aluminum clad panels for exterior, building facings has been known in the prior art for some period of time.

Aluminum Composite Cladding Systems are generally comprised of Aluminum Composite Material (ACM) panels, where panel flatness and a high performance finish are essential. Made from two sheets of aluminum bonded to a thermoplastic core, ACM is strong yet lightweight and with the right product knowledge and equipment, can be fabricated into components and systems that outperform other cladding materials in most situations.

The following prior art discloses the various aspects in the design and use of the joined interlocking aluminum sections.

U.S. Pat. No. 4,021,987, granted May 10, 1977, to Fritz Schnebel, et al., discloses the use of tie beams and girders for use in retaining façades constructed from prefabricated elements. A façade is mounted thereon simply by attaching a retaining strip and interposing packing elements, whereupon the tie beams and girders of aluminum are capable of absorbing horizontal or vertical displacements of the façade within a specific tolerance range.

U.S. Pat. No. 4,452,029, granted Jan. 5, 1984, to Ronald D. Sukolics, provides a clip having an inward force or pressure, wherein panel interlocks, which are ridges running longitulinally along the length of side, press against the panel member, having grooves on the inner sides of the turned down edges. (Column 2, lines 41-48) The citation further states, at Column 2, line 46: "An insert strip 26 is located between turned down edges 22 such that grooves 24 are maintained in cooperation with interlocks 18 and 20."

U.S. Pat. No. 5,842,315, granted Dec. 1, 1998, to William H. Porter, discloses an insulated structural panel with a flat insulating core, first and second outer facings attached to opposed lateral surfaces of the insulating core, with a liner, elongated metal strip disposed between and attached to the insulating core and the first outer facing to the extended length of the panel for increasing the bending strength of the panel.

U.S. Pat. No. 6,470,629, granted Oct. 29, 2002, to R. M. Haddock, discloses an apparatus for securing members to a surface. The apparatus includes a mounting clamp, a mounting adaptor, a panel support member and a fastener. The panel support member and the mounting adaptor are slidably interconnected to one another. The mounting adaptor is fixedly interconnected to the mounting clamps using the fastener. The mounting adaptor may also include an area of reduced strength to permit the controlled failure of the apparatus in response to excess loading. The panel support member may be adapted to receive a panel. When installed on a surface, the apparatus obscures the view of mounting devices or equipment that may also be secured to the surface.

U.S. Pat. No. 6,817,147, granted Nov. 16, 2004, to Douglas B. MacDonald, discloses a clip for panel trim that is a U-shaped flexible member defining a base and extending arms with end portions extending inwardly for insertion in openings of a partition frame member to retain the clip on the frame so that the base is separated from the frame for routing of utility lines on the partition frame member and through the clip.

What is needed is a coplanar ACM panel mounting system, utilizing a clip for retaining said ACM panels in forming a facing construction system, wherein the said novel clip is adapted to be removably secured to a substructure frame. In this regard, the present invention fulfils this need.

It is therefore an object of the present invention to provide a coplanar ACM panel mounting system, utilizing a clip having a pair of deformable sidewall arms rising from a base at proximately right angles, wherein said arms and base define a U-shaped clamping member for the insertion and retention of ACM panels therein.

It is another object of the present invention to provide a deformable clip formed in an extrusion process, whereby adjacent ACM panels can be aligned in a coplanar formation to obtain a smooth surface in either a flat, cylindrical, curved or wave formation facing and wherein a plurality of coplanar panels can be positioned to form a multiplanar array.

It is still another object of the present invention to provide a clip as a structural element having a hole in the base, coacting with an associated mounting screw, for removably fastening the clip to a supporting frame, thereby forming a non-progressive system that enables removal of individual panels for replacement or repair.

It is still yet another object of the present invention to provide an extrudable frame member having a pair of pedestaled leg extending downward from the base of the extruded channel to prevent the base of the frame member from contacting the hard surfaces of cement and brick.

Yet still another object of the present invention is to provide an extruded frame member having a friction grip comprising a sawtooth edge on an internal portion of each arm extending upward from the base of the extrudable frame member that forms a frictional retention means.

A better understanding of these and other objects and advantages of the present invention will be best understood from the following description of the specific embodiments when read and understood in connection with the accompanying drawings.

SUMMARY OF THE INVENTION

The present invention relates primarily to a U-shaped retaining clip for the retention of aluminum composite material (ACM) panels in a composite aluminum cladding system, wherein the clip is deformable to provide for the self-adjustment and retention of adjacent panels to obtain a smooth coplanar facing.

The composite aluminum cladding system includes a welded frame comprised of sections of extruded aluminum channels designed to receive the edge members of the aluminum composite material panels. Each ACM panel becomes self-aligning coplanarly by inserting the precision precut edges into the corresponding receiving cavity of the extruded aluminum channel. When the edge of each panel comes in contact with the bottom at the base of the extruded channel, the flat surface of each panel should lie in the same plane, which then will give a smooth surface for the panel arrangement.

The adjacent panels are then retained by inserting the novel extruded clip into the slotted opening between the side members of the adjacent panels. A single self-drilling flat-head screw is then inserted through the hole provided in the base of the novel extruded clip.

The clip installation is completed by passing the self-drilling screw through the hole in the base of the clip and screwing it into the extruded frame member. As each screw is rotated, it progresses downwardly until the countersink edges beneath the head of the screw comes in contact with the mated chamfered edge of the novel extruded clip. Further rotation of the screw causes the arms of the clip to separate and spread apart, thereby forcing the tips of the arms to symmetrically imbed into the edge of the panel members, which results in captivating the adjacent panel members.

BRIEF DESCRIPTION OF THE DRAWINGS

A complete understanding of the invention may be obtained by reference to the accompanying drawings when taken in conjunction with the detailed description thereof and in which:

FIG. 22A is an enlargement showing end portions of the frame secured to the building structure.

FIG. 22B is an enlargement of a first frame bend.

FIG. 22C is an enlargement of the frame showing a second bend of the frame.

DETAILED DESCRIPTION OF THE PRESENT INVENTION

An apparatus and method are provided in accordance with the present invention to allow an easy, as well as, economical installation of ACM panel members and frame structure to a building surface. The present invention is directed to securing the panel members to building surfaces, including a flat, curved or wavelike surface.

Figure 1:
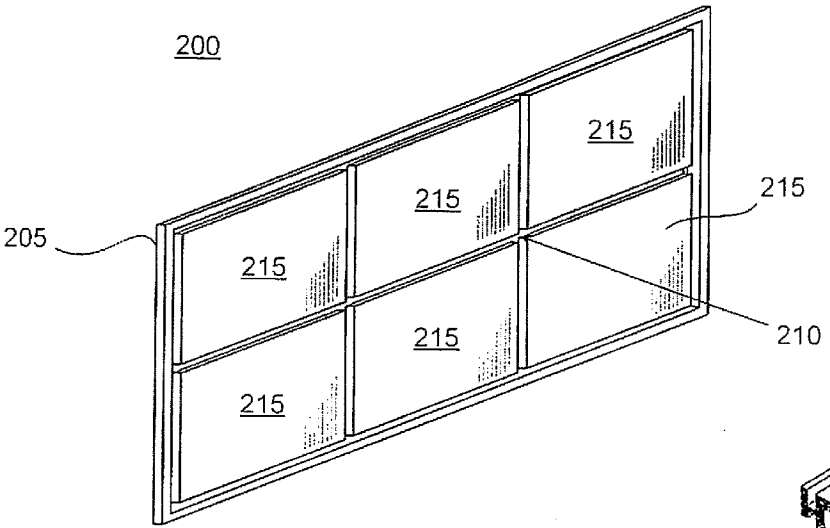
FIG. 1 is a perspective view of an aluminum composite cladding system comprised of the frame and ACM panels held in place by the novel retention clips, (as shown in FIG. 3).

The Aluminum Composite Cladding System 200, as shown in FIG. 1, is comprised of an extruded frame 205 that is of welded construction and configured to receive a plurality of Aluminum Composite Material (ACM) panels 215, where the side members of the panels are inserted into the collective cavity of said frame, each adjacent panel will lie in a coplanar manner.

Figure 2:
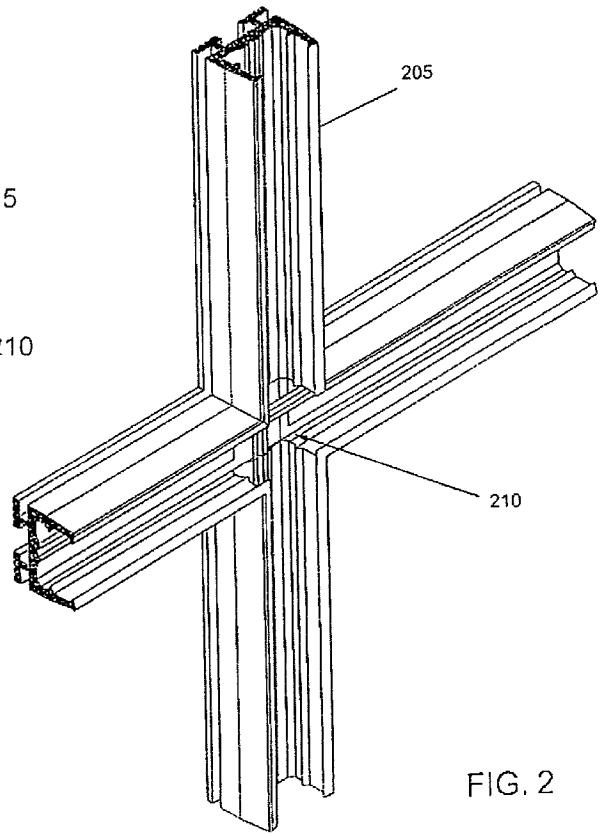
FIG. 2 is a perspective view of a typical welded intersection of the horizontal and vertical frame members.
Figure 2A:
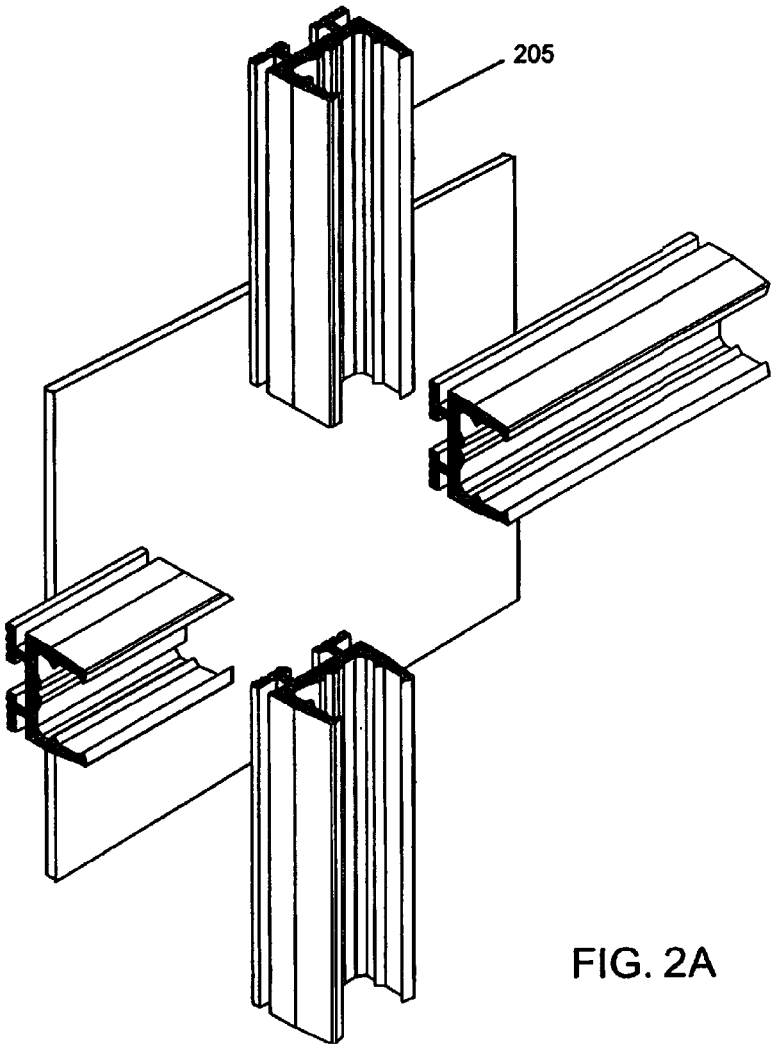
FIG. 2A is a perspective view of an alternative means for intersection of the horizontal frame members.

There is shown in FIG. 2, a typical welded intersection 210 of the horizontal and vertical frame members 205; FIG. 2A provides an alternate means for intersection.

Figure 3:
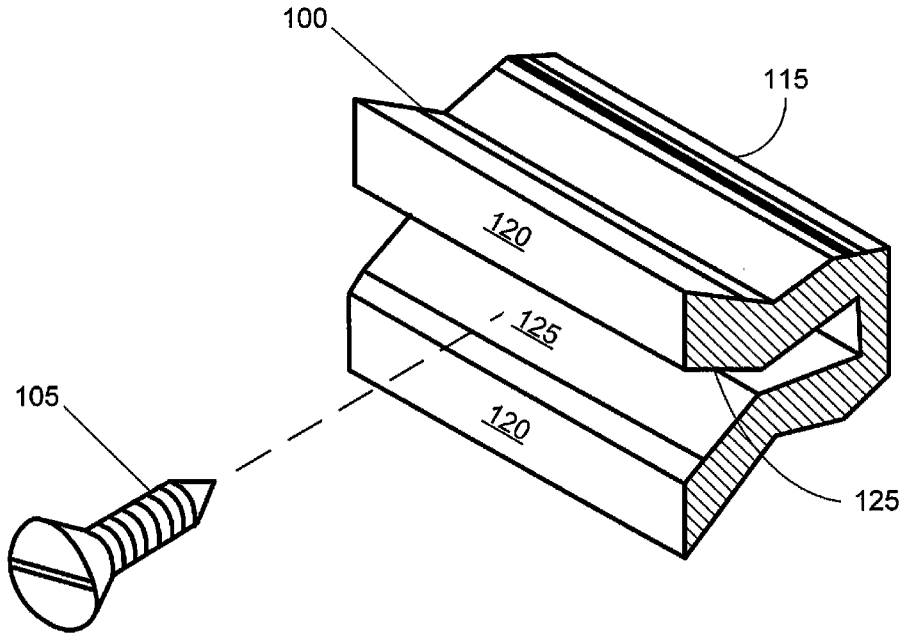
FIG. 3 is a perspective view of the novel extruded clip with its associated self-drilling mounting screw.

The clip 100 shown in FIG. 3 is a structural element for retaining panels 215, comprising aluminum clad material (ACM), to a frame member 205. This novel compliant, deformable clip 100 is formed in an extrusion process into suitable extruded lengths for ease in handling. The extruded lengths are then sheared into a plurality of clips having shorter lengths, preferably two inches in length. Orthogonal to the base 115 are two arms 120, each having beveled planes 125 on its inward facings A flat head, self-drilling, screw 105 is used to secure the clip during the installation by passing through a hole in the base of the clip. The screw 105 is preferably a flat head self-drilling screw; having an 80 to 82 degree included angle that mates with the included angle formed by the beveled planes 125. Alternatively, oval head self-drilling screws can be used instead of the flat head self-drilling screws.

The subject clip 100 is a structural element, owing to its outstanding panel retaining function in securing the ACM panels to the frame 205. A fastener hole 110 is punched through the base 115 for removably fixing the clip 100 to its supporting frame 205, via mounting screws 105.

In the prior art, as in panel facing assemblies, the removal of a single panel for repair or replacement requires the removal of an entire section of the facing because the panels are interdependent. However, use of the novel clip of the present invention provides an assembly wherein each individual panel is removable. The subject clip in this non-progressive system enables removal of individual panels for replacement or repair.

Figure 4:
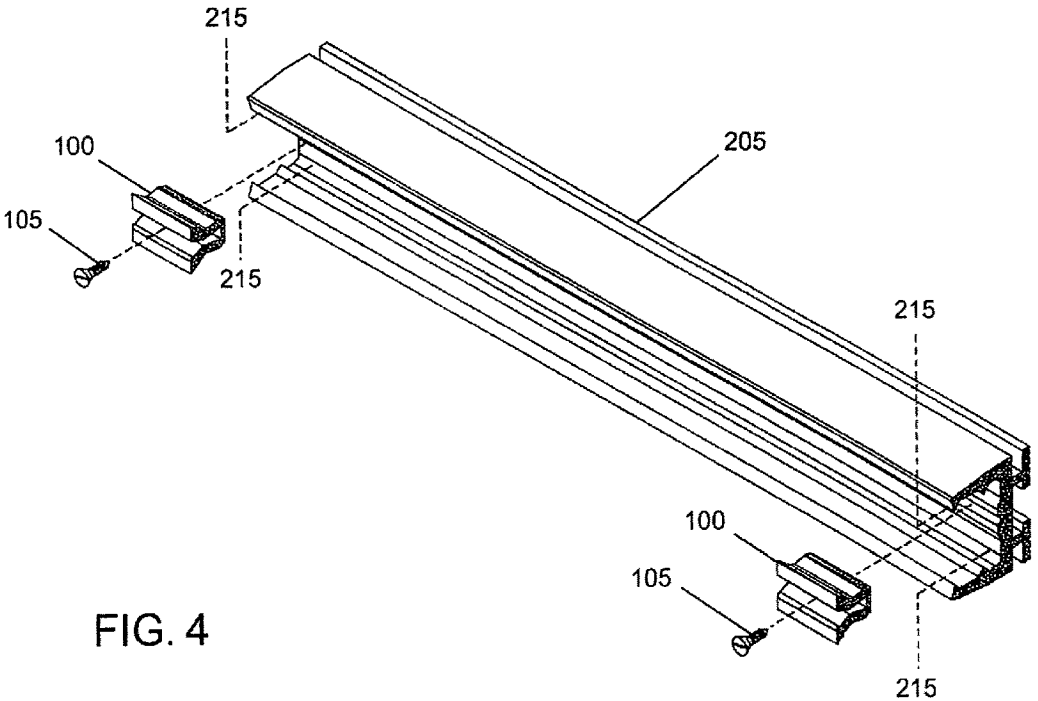
FIG. 4 is a perspective view of a typical section of a frame member, illustrating the typical placement of the novel panel-retaining clips prior to the insertion of the panels.
Figure 5:
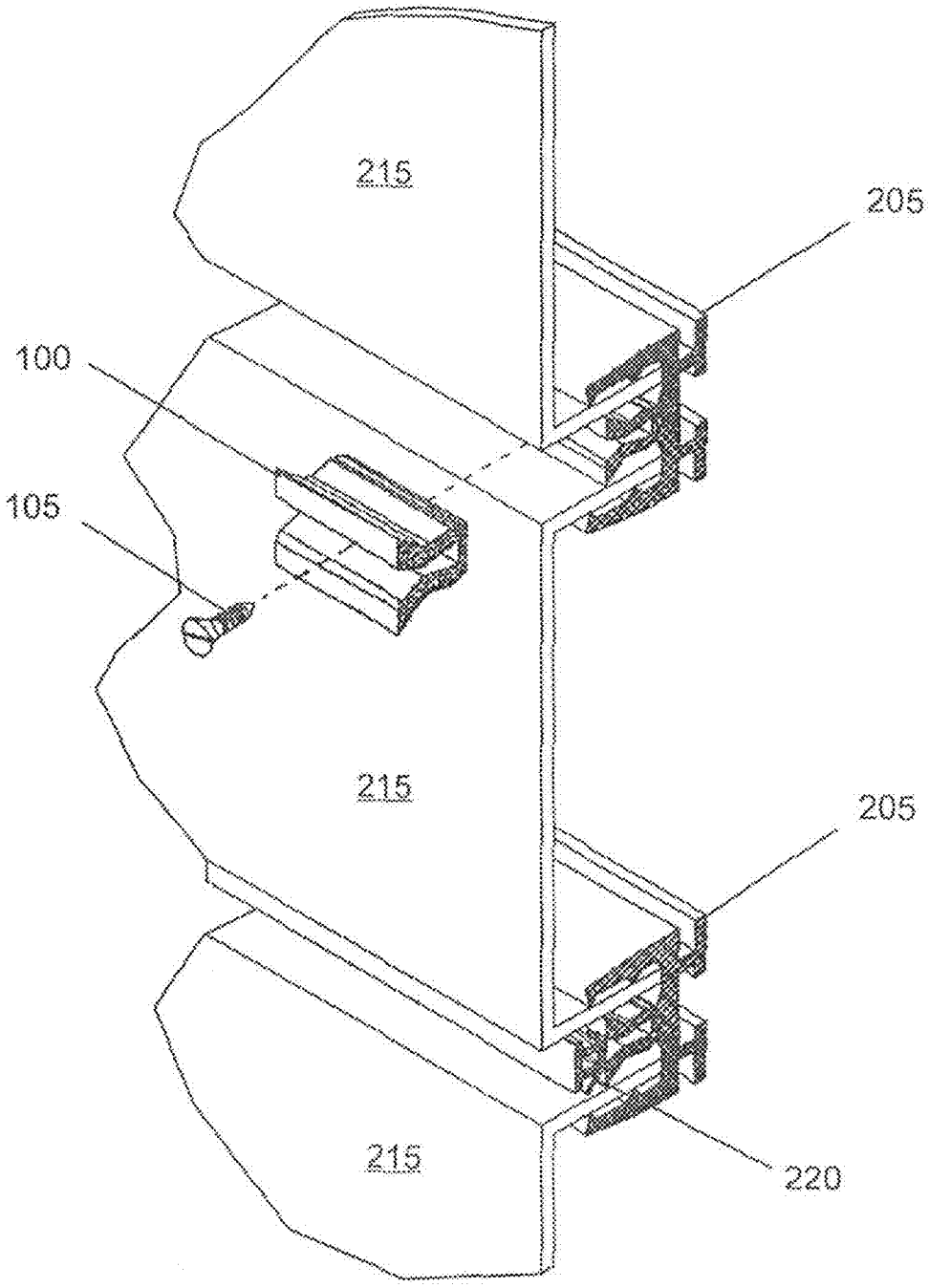
FIG. 5 is an exploded perspective view of the ACM panels inserted into the collective cavities of the extruded frame members, subsequently clamped by the novel panel-retaining clips, and finished with a gasket inserted into the slotted opening between adjacent panels.

A typical section of a frame member 205, as shown in FIG. 4, illustrates the typical placement of the novel panel-retaining clips 100 prior to the installation of the panels 215. As the ACM panels 215 are inserted into the collective cavities 245 of the extruded frame members 205, as shown in FIG. 5; the novel panel-retaining clips 100 subsequently retain them. After the panels 215 are seated into the frame member cavities 245 and retained by the novel clips 100, a gasket 220 is inserted into the slotted opening between adjacent panels 215 to complete the installation of the aluminum composite cladding system 200.

Figure 6:
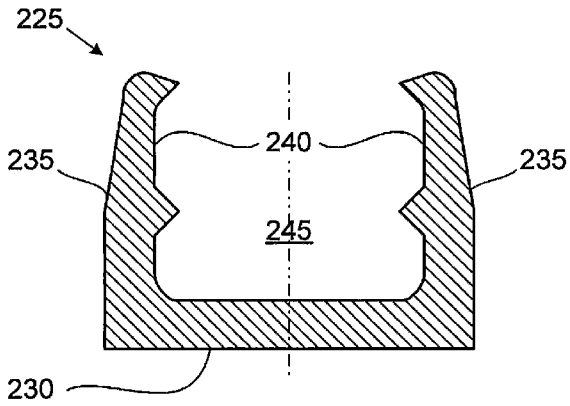
FIG. 6 is a transverse sectional view of a first embodiment of the narrow slot frame member, without pedestal spacers, thereby permitting the base of the frame member of the aluminum composite cladding system to be mounted directly to a building wall or mounted using wood fining strips to provide a surface into which screws can penetrate.

Turning now to FIG. 6, there is shown is a transverse sectional view of a first embodiment of the narrow slot frame member 225, without pedestal spacers. The frame member 225 is comprised of the base 230 and having two upright arms 235, each arm orthogonal to the base 230 forming a U-shaped member. The collective cavity 245 of the narrow frame member 225 is designed to receive the edge members of two adjacent panels 215, slidably fit, and separated by a narrow slot opening, preferably 0.500 inches, between panels 215, into which the novel extruded clips 100 may be inserted.

Figure 7:
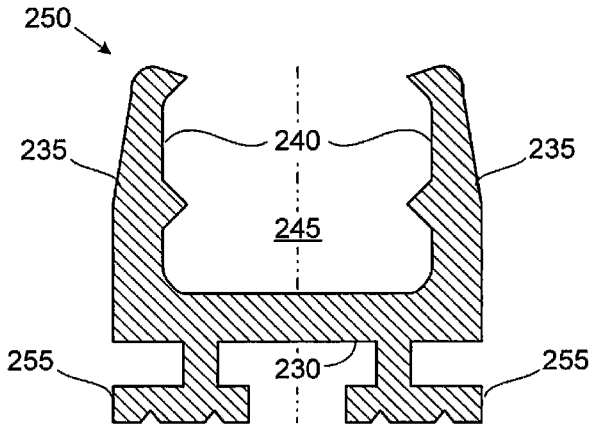
FIG. 7 is a transverse sectional view of a second embodiment of a narrow slot frame member having a pair of pedestal spacers, for separation of the rigid frame from hard surfaces and to prevent the base of the frame member from contacting a hard surface such as cement, brick or block which may lie behind the frame member.

In a second embodiment of the present invention, FIG. 7 depicts a transverse sectional view of a narrow slot frame member 250 having a pair of pedestal spacers 255, to provide for the separation of the frame 205 from the hard mounting surfaces and to prevent the frame from contacting a hard surface such as cement, brick or block which may lie behind the frame member.

Figure 8:
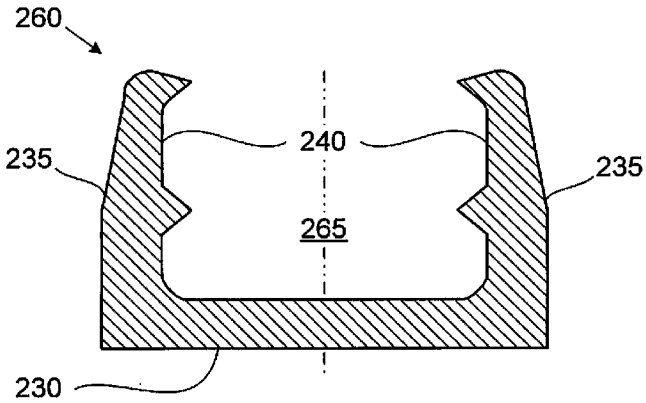
FIG. 8 is a transverse sectional view of a third embodiment of a wide slot frame member, without pedestal spacers, to permit the base of the frame member of the aluminum composite cladding system to be mounted directly to a building wall or mounted using wood fining strips to provide a surface into which screws can penetrate.

A third embodiment of the present invention is shown in FIG. 8 where the wide slot frame member 260, without pedestal spacers, permits the frame 205 of the aluminum composite cladding system 200 to be mounted directly to a building wall or mounted using wood fining strips to provide a surface into which the mounting screws can penetrate.

The frame member 260 is comprised of base 230 and having two upright arms 235, each arm orthogonal to the base 230 forming a U-shaped frame member. The collective cavity 245 of the wide frame member 260 is designed to receive the edges of two adjacent panels 215, slidably fit, and separated by a wide slotted opening, preferably 0.750 inches between panels 215, into which the novel extruded clips 100 may be inserted.

Figure 9:
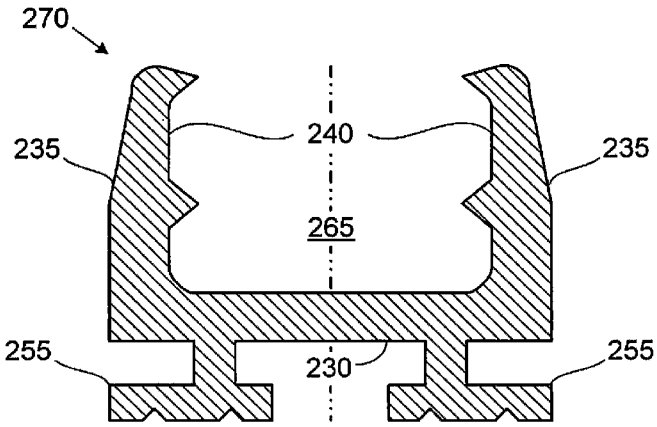
FIG. 9 is a transverse sectional view of a fourth embodiment of a wide slot frame member having a pair of pedestal spacers, to stand off the base of the frame member from hard surfaces and to prevent the frame member from contacting a hard surface such as cement, brick or block which may lie behind the frame member.

FIG. 9 is shows a fourth embodiment of having a wide slot frame member 270, supported upon a pair of pedestaled spacers 255, to stand off the base of the frame member from hard surfaces and to prevent the frame member from contacting a hard surface such as cement, brick or block which may lie behind the frame member 270.

Figure 10:
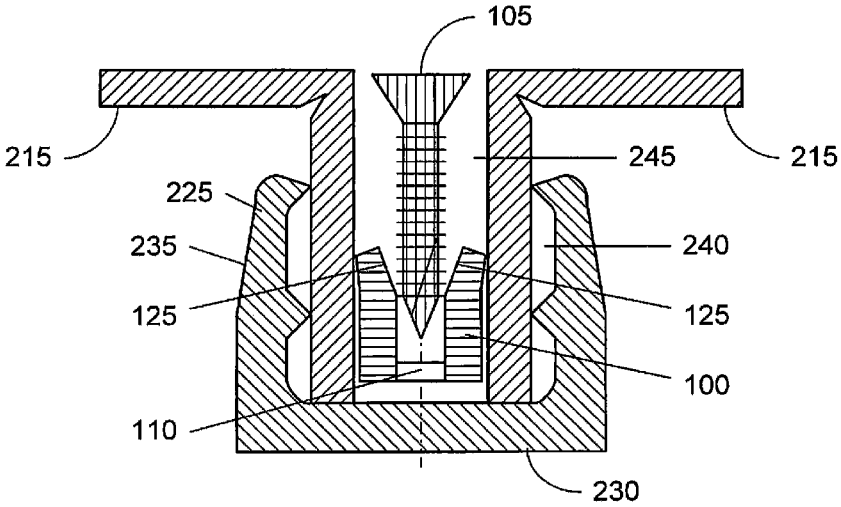
FIG. 10 is a transverse sectional view of a narrow slot frame member assembly showing the adjacent panels inserted into the collective cavity where the novel, retaining clip with drilling-screw, is inserted into the slotted opening between the panels.
Figure 11:
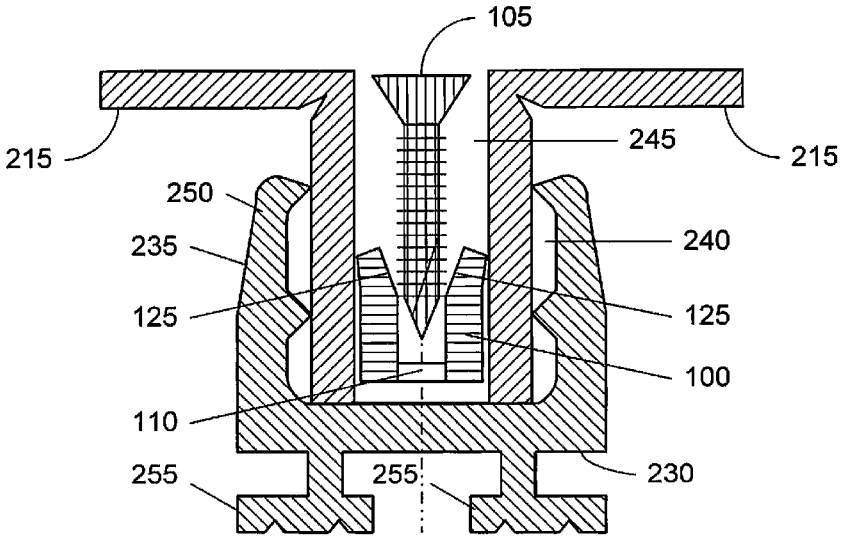
FIG. 11 is a transverse sectional view of a narrow slot frame member assembly showing the adjacent panels inserted into the collective cavity of a pedestaled frame member, where the novel retaining clip with drilling-screw, is inserted into the slotted opening between the panels.

FIGS. 10 and 11 best illustrate the installation of this novel panel retentive clip 100. The edge members of the ACM panels 215 are inserted into the collective cavity 245 of the extruded frame members 205 until the edge members of the panel come in contact with base 230 for an equidistant, self-alignment at the bottom of the collective cavity 245. The self-drilling screw 105 is inserted into the central portion of the novel, retaining clip 100 and guided through the hole 110, where the clip 100 and self-drilling screw 105 are placed into the slot opening between the two adjacent panels 215. By pressing the screw 105 downward while rotating it in a clockwise direction, the self-drilling screw 105 penetrates the base of the extruded frame member 230, becoming self-threading, while drawing the conical portion beneath the head of the screw 105 to come in contact with the beveled edge 125 of the novel retaining clip 100.

Figure 12:
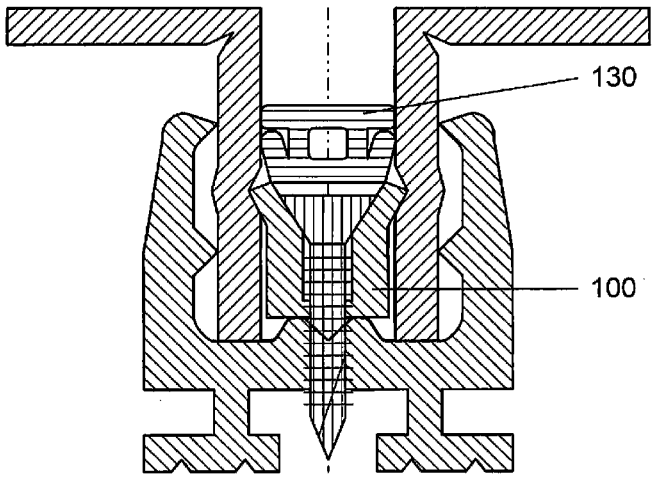
FIG. 12 is a transverse sectional view of a narrow slot, pedestaled frame member assembly showing the slotted opening having an unfinished appearance of the slotted opening.
Figure 13:
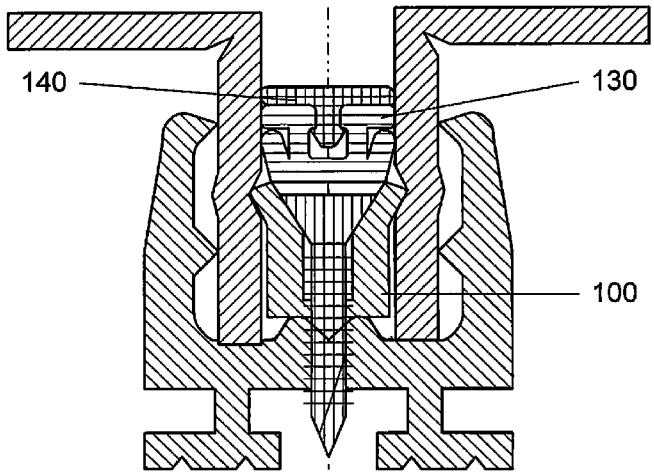
FIG. 13 is a transverse sectional view of a narrow slot pedestaled frame member assembly showing a backer rod mounted in the slotted opening, which is subsequently covered with caulk to provide a finished appearance to the slotted opening.

The downward force exerted upon the surface of the beveled edges 125 then forces the vertical arms 120 of the clip to separate and open, thereby forcing the edges of the arms 120 to symmetrically imbed into the edge members of the panel members 215, as shown in FIGS. 12 through 17, which results in the captivation of the adjacent panel members in the indention area 240. In FIGS. 12 and 13, the fact that panel members 215 may be slightly deformed by an inward pressure of vertical arms 235, which indicates retention of the arms 235 by means of a deformation or deformation grip.

Once the panels are seated into the frame member cavity 245 and retained by the novel clips 100, an extruded gasket 130 is inserted into the narrow slotted opening between adjacent panels 215 to complete the installation of the aluminum composite cladding system 200, as shown in FIG. 12

FIG. 13 shows a narrow slot frame member assembly 225 having an extruded gasket 130 covered with a metal insert 140, to provide a finished appearance to the slotted opening.

Figure 14:
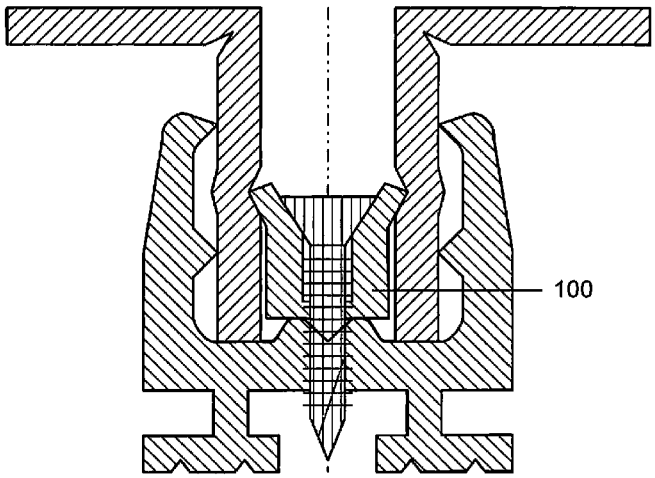
FIG. 14 is a transverse sectional view of a narrow slot frame member assembly showing an extruded gasket that is used to provide a finished appearance to the slotted opening.

FIG. 14 shows a narrow slot, pedestaled frame member assembly 250 showing the slotted opening having an unfinished appearance of the slotted opening.

Figure 15:
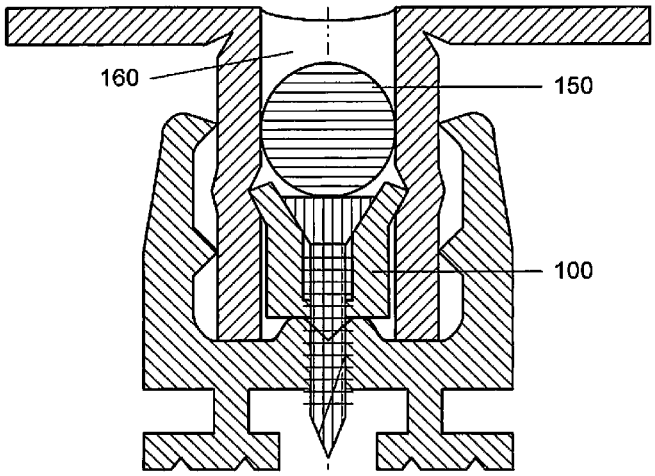
FIG. 15 is a transverse sectional view of a narrow slot frame member assembly showing an extruded gasket covered with a metal insert that is used to provide a finished appearance to the slotted opening.

FIG. 15 shows a narrow slot, pedestaled frame member assembly 260, where a backer rod 150 is mounted into the slotted opening, and is then covered with caulk 160 to provide a finished appearance to the slotted opening.

Figure 16:
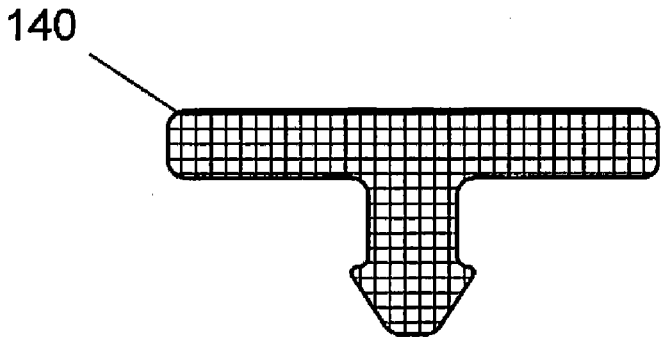
FIG. 16 is a cross-sectional view of a narrow slot metal insert.
Figure 17:
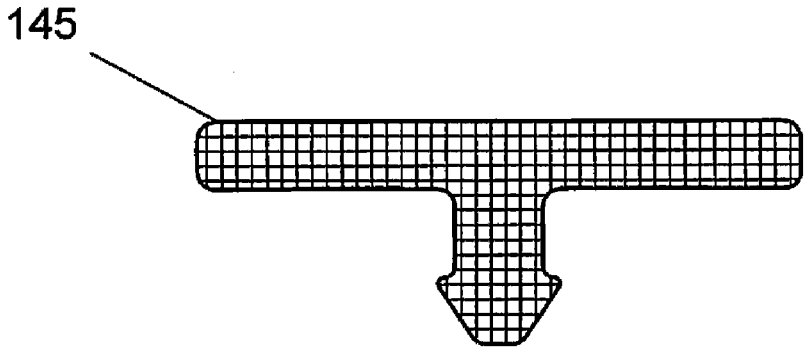
FIG. 17 is a cross-sectional view of a wide slot metal insert.

The narrow slot metal insert 140, as used in FIG. 13, is shown in FIG. 16. The wide slot metal insert 145 is shown in FIG. 17.

Figure 18:
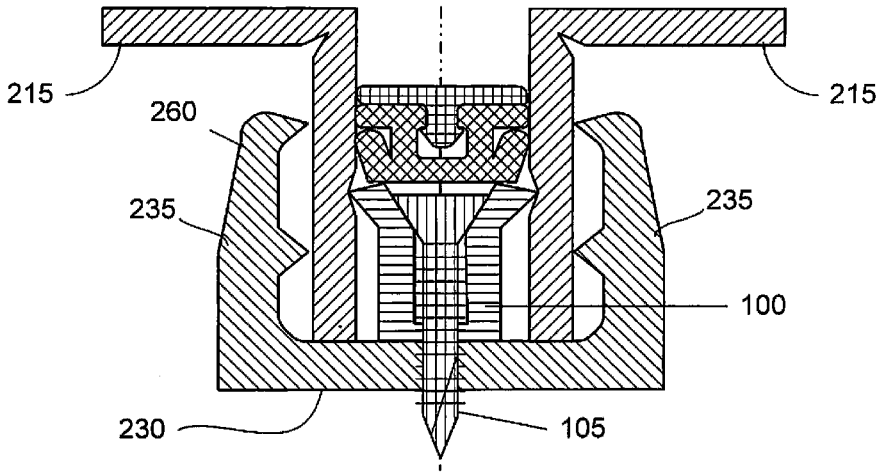
FIG. 18 is an example of a transverse sectional view of a wide slot frame member assembly showing the adjacent panels inserted into the collective cavity of a frame member, where the novel retaining clip, with drilling-screw, is inserted into the slotted opening between the panels and an extruded gasket covered with a metal insert is used to provide a finished appearance to the slotted opening.

FIG. 18 is an example of a wide slot frame member assembly 260 showing the adjacent panels 215 inserted into the collective cavity 245 of a frame member 205, where the novel retaining clip 100 with drilling-screw 105, is inserted into the slotted opening between the panels and an extruded gasket 135 covered with a metal insert 145 is used to provide a finished appearance to the slotted opening.

Figure 19:
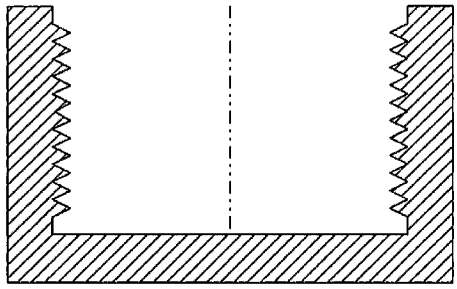
FIG. 19 shows an important aspect of the invention, which is to provide an extruded frame member having a friction grip with a sawtooth edge on an internal portion of each upright arm of the frame member to form a frictional retention means.

FIG. 19 shows an important aspect of the invention, which is to provide an extruded frame member having a friction grip with a sawtooth edge on an internal portion of each upright arm of the frame member to form a frictional retention means.

Figure 20:
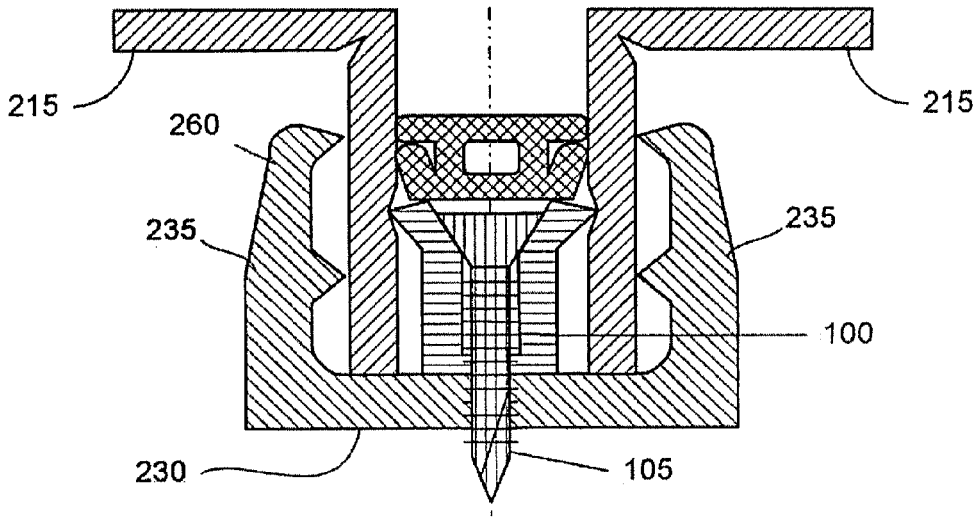
FIG. 20 is an example of a transverse sectional view of a wide slot frame member assembly showing the adjacent panels inserted into the collective cavity of a frame member, where the novel retaining clip, with drilling-screw, is inserted into the slotted opening between the panels and an extruded gasket cover is used to provide a finished appearance to the slotted opening.

FIG. 20 is an example of a transverse sectional view of a wide slot frame member assembly showing the adjacent panels inserted into the collective cavity of a frame member, where the novel retaining clip, with drilling-screw, is inserted into the slotted opening between the panels and an extruded gasket cover is used to provide a finished appearance to the slotted opening.

Figure 21:
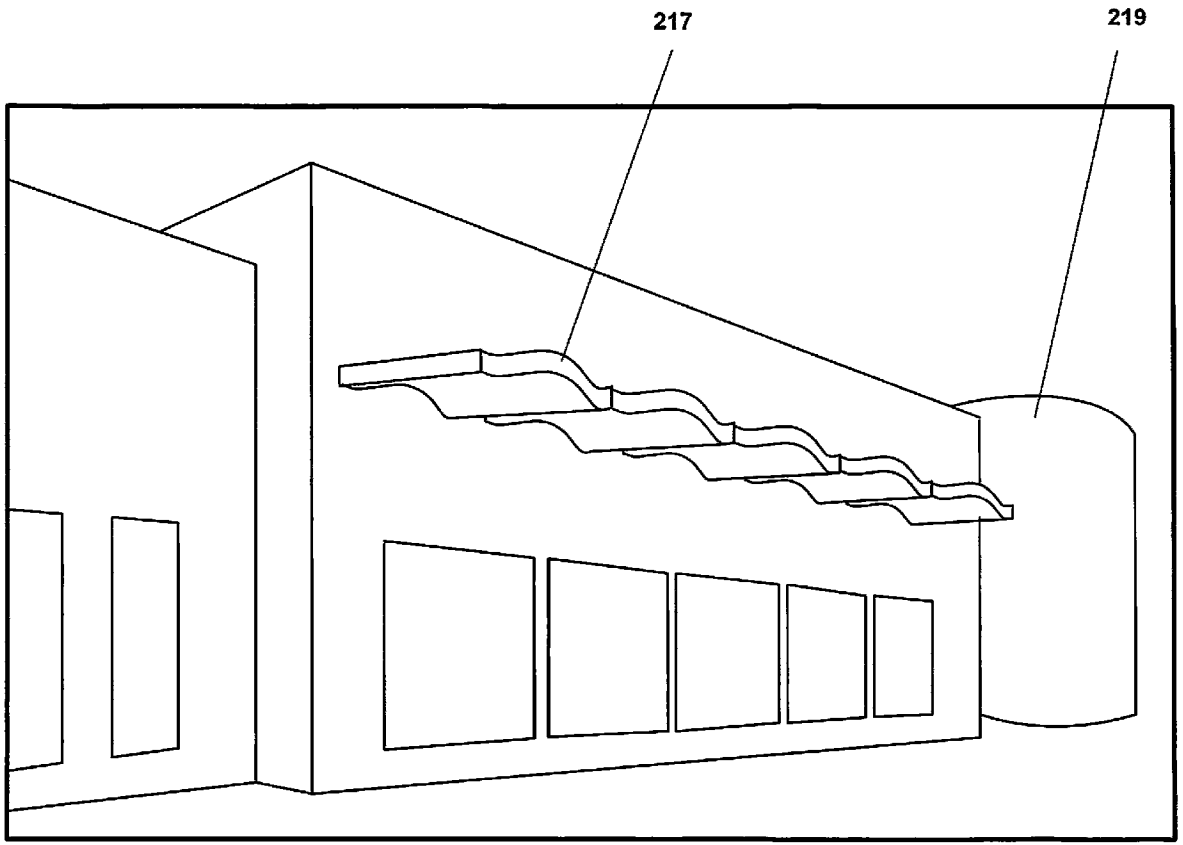
FIG. 21 shows the coplanar ACM panel mounting system with the adjacent ACM panels aligned in a coplanar formation that flows in a smooth multiplanar wave formation surface facing.

FIG. 21 shows the coplanar ACM panel mounting system with the ACM panels aligned in a coplanar formation that flows in a smooth multiplanar wave formation surface facing 217. FIG. 21 also features the coplanar ACM panel mounting system, wherein the ACM panels provide a cylindrical array formation 219.

Figure 22:
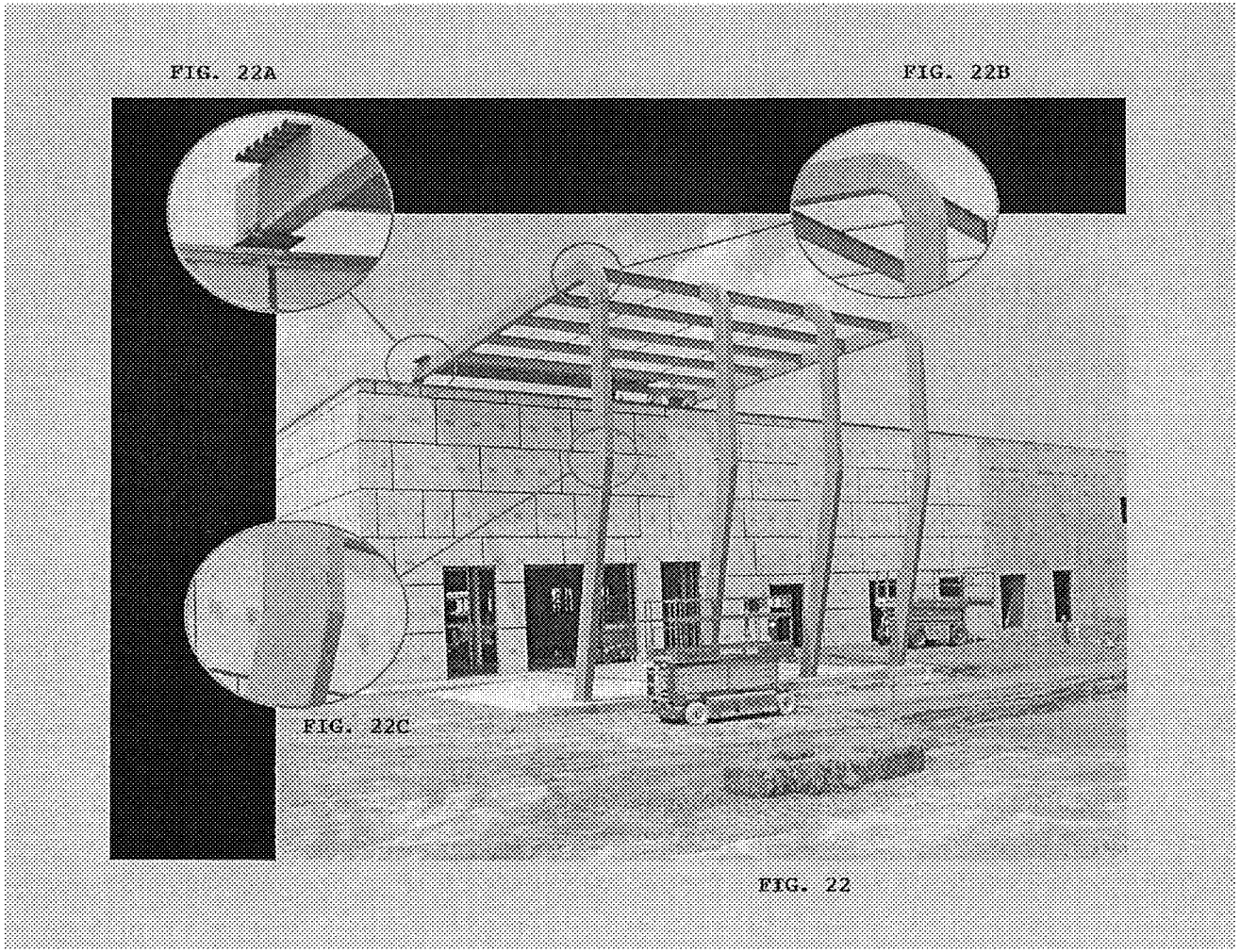
FIG. 22 shows how the frame can be bent to form a desired building facing.

In FIG. 22, the frame is structured as in the enlargement FIG. 22A and bent as shown in enlargements FIGS. 22B and 22C, and through the use of the foregoing mounting system secured by the novel clip, the ACM panel facing takes on the desired shape of the frame, whether a wave formation 217 or a cylindrical formation 219 of FIG. 21 or any other shape desired for a building facing.

While the present invention is described in detail for its particular embodiments, there may be other variations and modifications that will become apparent to those who are skilled in the art upon reading this specification, and that these modifications or variations that can be made should not detract from the true spirit of this invention.

The invention claimed is:

1. An aluminum cladding system comprising a frame of channeled frame members to receive precision precut panel edges of adjacent panels, wherein each panel is self-aligned coplanarly by insertion of its edge into the channeled frame member in contact with a channel bottom, wherein a surface of adjacent panels are in the same plane for a smooth surface of a panel arrangement; a U-shaped retaining clip having a base and two upwardly extending, deformable sidewall arms that are forced apart by installation of a self-drilling screw, that passes through a hole in the base of the clip and into the frame member wherein countersink edges beneath a head of the screw contact mated chamfered edges of the clip; wherein a further rotation of the screw causes the arms of the deformable clip to separate, spread apart and force tips of the arms to symmetrically imbed into the precision precut edges of the panel members for captivation of the adjacent panels; wherein the retentive clip and screw mount and retain adjacent aluminum composite material (ACM) panels to lie in a coplanar manner on an extruded frame in a non-progressive system whereby individual panels are removable for replacement or repair.

2. An aluminum cladding system as defined in claim 1, wherein the frame is linear and the adjacent ACM panels are secured by the clip in a coplanar formation to obtain a smooth, flat surface facing.

3. An aluminum cladding system as defined in claim 1, wherein the frame includes a plurality of curved formations and the adjacent ACM panels are secured by the clip to the plurality of curved formations of the frame to obtain a smooth, wave formation of a building facing.

4. An aluminum cladding system as defined in claim 1, wherein the frame includes a cylindrical formation and the adjacent ACM panels are aligned coplanarly in the cylindrical formation to obtain a smooth, cylinder formation of a building facing.

5. A coplanar ACM panel mounting system in accordance with claim 1, wherein the deformable clip includes a pair of pedestal legs extending downward from the base of an extrusion channel in the clip to prevent the base of the frame member from contacting the hard surfaces of cement and brick.

6. A coplanar ACM panel mounting system in accordance with claim 5, wherein the deformable clip includes a friction grip comprising a sawtooth edge on an internal portion of each arm that extends upward from the base of the extrudable frame member that forms a frictional retention means.

7. A self-leveling structural element, comprising:

a U-shaped slot member having a base and two orthogonal upwardly extending deformable arms defining a clamping chamber, each arm having a beveled plane on an inward facing thereof, and the base including a fastener hole to receive a fastener that removably secures a conical clip and the slot member to a substructure frame; wherein each precision precut edge of adjacent ACM panel sections is inserted within the clamping chamber to contact the base; a frictional grip and deformation retention of the panel sections provided by rotation of the fastener with pressure on an underlying radially flared countersink on the conical clip that causes the clip to separate and spread apart, and to symmetrically imbed into each precision precut edge and captivate the adjacent ACM panel sections between the conical clip and the beveled plane of each arm.

8. The self-leveling structural element as recited in claim 7, further comprising a flexibility of the clip to achieve a camber of the retained panels that are leveled to a smooth, linear surface in flat or rounded facings.

9. The self-leveling structural element as defined in claim 8, wherein a plurality of coplanar panels are positioned to form a multiplanar array.

10. The self-leveling structural element as recited in claim 9, further comprising an extruded gasket cover that is inserted over the fastener to provide a finished appearance to the U-shaped clip.

11. The self-leveling structural element as recited in claim 9, wherein a backer rod is mounted over the fastener and then covered with caulk to provide a finished appearance to the U-shaped clip.

12. The self-leveling structural element as recited in claim 11, wherein an extruded gasket with a metal insert is inserted over the fastener to provide a finished appearance to the U-shaped clip.

* * * * *